US008505739B2

(12) United States Patent
Betti

(10) Patent No.: US 8,505,739 B2
(45) Date of Patent: Aug. 13, 2013

(54) DEVICE FOR DISCARDING TRIMS FORMED DURING THE CUTTING OF PAPER LOGS

(75) Inventor: Giulio Betti, Vorno (IT)

(73) Assignee: Futura S.p.A., Capannori (LU) (IT)

( * ) Notice: Subject to any disclaimer, the term of this patent is extended or adjusted under 35 U.S.C. 154(b) by 0 days.

(21) Appl. No.: 13/342,445

(22) Filed: Jan. 3, 2012

(65) Prior Publication Data

US 2012/0097502 A1 Apr. 26, 2012

Related U.S. Application Data

(63) Continuation of application No. 12/746,836, filed as application No. PCT/IT2008/000754 on Dec. 10, 2008, now Pat. No. 8,167,136.

(30) Foreign Application Priority Data

Dec. 12, 2007 (IT) ..... FI2007A0279

(51) Int. Cl.
*B07C 5/06* (2006.01)

(52) U.S. Cl.
USPC ..... 209/620; 209/621; 198/588; 198/626.1

(58) Field of Classification Search
USPC ..... 209/620–622, 626, 665, 668; 83/89, 83/100; 198/460.2, 586, 588, 626.1, 812
See application file for complete search history.

(56) References Cited

U.S. PATENT DOCUMENTS

| | | | | |
|---|---|---|---|---|
| 4,429,517 | A * | 2/1984 | Lohrentz et al. | 56/181 |
| 4,462,287 | A * | 7/1984 | Weis et al. | 83/104 |
| 5,475,917 | A * | 12/1995 | Biagiotti | 29/822 |
| 6,332,527 | B1 * | 12/2001 | Wierschke | 198/369.7 |
| 6,868,958 | B2 * | 3/2005 | Betti et al. | 198/435 |
| 6,915,550 | B2 * | 7/2005 | Betti et al. | 29/426.1 |
| 7,080,738 | B2 * | 7/2006 | Gambini | 209/620 |
| 7,866,238 | B2 * | 1/2011 | Hsu | 83/175 |
| 8,167,136 | B2 * | 5/2012 | Betti | 209/620 |

* cited by examiner

*Primary Examiner* — Joseph C Rodriguez
(74) *Attorney, Agent, or Firm* — McGlew and Tuttle, P.C.

(57) ABSTRACT

A device for discarding trims formed by cutting machines during the cutting of paper logs, including an advancing plane on which paper rolls (R) and trims (RT, RC) advance along a given direction (A), wherein the trims can fall through a discontinuity provided on the advancing plane. The advancing plane is formed by a first extendible conveyor (1) and a second extendible conveyor (2). Each of the conveyors (1, 2) is connected with an extension and retraction device. The discontinuity on the advancing plane is realized or eliminated depending on the extended or not extended configuration of the conveyors (1, 2).

20 Claims, 15 Drawing Sheets

3
50
5
2
1
R
R
R
RC
RT
72
73
730
92
740
74
82
75
71
64
640
650
65
81
91
62
63
620
630

3
92
72
73
R
R
R
50
2
5
75
74
71
710
RC
RT
61
64
65
1
62
63

R
RC
RT
R
91
81
710
82
92
2
1
5
50
3

DEVICE FOR DISCARDING TRIMS FORMED DURING THE CUTTING OF PAPER LOGS

CROSS REFERENCE TO RELATED APPLICATIONS

This is a continuation under 37 CFR 1.53(b) of prior application Ser. No. 12/746,836 filed Jun. 8, 2010, now U.S. Pat. No. 8,167,136 which is a United States National Phase application of International Application PCT/IT2008/000754 filed Dec. 10, 2008 and claims the benefit of priority under 35 U.S.C. §119 of Italian Patent Application FI2007A000279 filed Dec. 12, 2007, the entire contents of each of the applications are incorporated herein by reference.

FIELD OF THE INVENTION

The present invention relates to a device for discarding trims formed during the cutting of logs of paper material.

BACKGROUND OF THE INVENTION

It is known that logs consisting of a predetermined amount of a paper web wound around a tubular cardboard core, which is usually made of cardboard, are used for producing rolls of toilet paper, rolls of kitchen blotting paper or similar rolls. Each log is subdivided into a given number of rolls having shorter lengths by means of a cutting machine. Since the two ends of the logs are normally orthogonal to the longitudinal axis of the cardboard core and the cardboard core may jut out of one or of both ends of the paper logs, for each log the cutting machine cuts first a reduced portion of the front end, and then it cuts pieces which correspond to rolls having the desired length. The last cut is performed on a reduced portion of the tail end of the log. The front and the tail end portions of the logs so produced, usually called trims, are to be discarded to avoid their packaging together with the rolls destined for sale.

Suitable devices, positioned between the exit of the cutting machine and the entrance of the packaging line, are used for this purpose and provide for the discarding of the trims.

EP0995559 discloses a device for transferring rolls, which have been obtained by cutting a log, from a first to a second conveyor, provided with a mechanism for moving away the trims which are present at the beginning and at the end of each succession of rolls. The mechanism comprises two shuttles mounted on a framework associated with the first and the second conveyor and which are so shaped that they provide a sliding plane for the rolls or an empty space between the first and the second conveyor depending on their reciprocal position. More precisely, whenever it is necessary to produce an empty space between the first and the second conveyor, the two shuttles are distanced from each other, so the trims coming from the first conveyor fall downward under the effect of gravity. In this way, it is possible to avoid the transfer of the trims from the first to the second conveyor.

EP 1281487 discloses a device for eliminating trims from a succession of rolls coming from a cutting machine. The device is disposed and acts downstream of a feeding unit for the rolls and trims coming from the cutting machine and it consists of a ring-closed conveyor. The conveyor is provided with an opening the size of which allows the trims to fall through it. The opening is disposed at the end point of the feeding unit by suitably handling the conveyor, whenever the head and tail trims of the succession of rolls reach a given point.

US44 622287 discloses a mechanism for eliminating or discarding trims from a succession of rolls obtained by subdividing a log which, unlike the cases mentioned above, does not imply a system positioned and acting between the feeding units upstream and the collecting units downstream, provides for the use of a device for modifying the shape of the collecting unit downstream. More particularly, the conveyor which transports the rolls coming from the cutting machine has a variable length, as it can assume an elongated position in which it is close to the conveyor upstream or a retracted position in which it is distanced from the conveyor. Thus, when the rolls are transferred, the second conveyor is elongated so as to provide a basically continuous transferring surface between the first and the second conveyor. On the contrary, in order to avoid transferring a trim from the first to the second conveyor, the second conveyor is retracted so as to produce an empty space into which the trim may fall under gravity.

A similar device is described in US6607082 which relates to a device for eliminating or discarding trims which provides for the modification of the shape of the conveyor destined to move the rolls away from the cutting machine.

US2003/0167887 describes a device for eliminating or discarding trims which is somehow hybrid with respect to those described above, as it provides for the use of belts having a variable conformation disposed and acting between a unit for moving away the rolls and the trims produced and the trims produced by a cutting machine and a unit for collecting the single rolls.

EP0982106 discloses a device for eliminating or discarding trims which provides for subdividing into two sections the conveyor for collecting the single rolls: the section which is closer to the belts for moving the rolls and the trims away from the cutting machine can be rotated so that it can be lifted to avoid the passage of trims to the second section or it can be lowered and put in a horizontal position so as to form a bridge for transferring the single rolls which, in this way, pass from the cutting machine to the second section.

SUMMARY OF THE INVENTION

The main aim of the present invention is to propose a device for discarding trims produced with the cutting of paper logs which is much more efficient and capable of serving quicker cutting machines according to the current production requirements.

Thanks to the present invention, it is possible to remove the trims with the utmost precision and efficiency and to increase the production, with a relatively simple device which is also economical and reliable.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
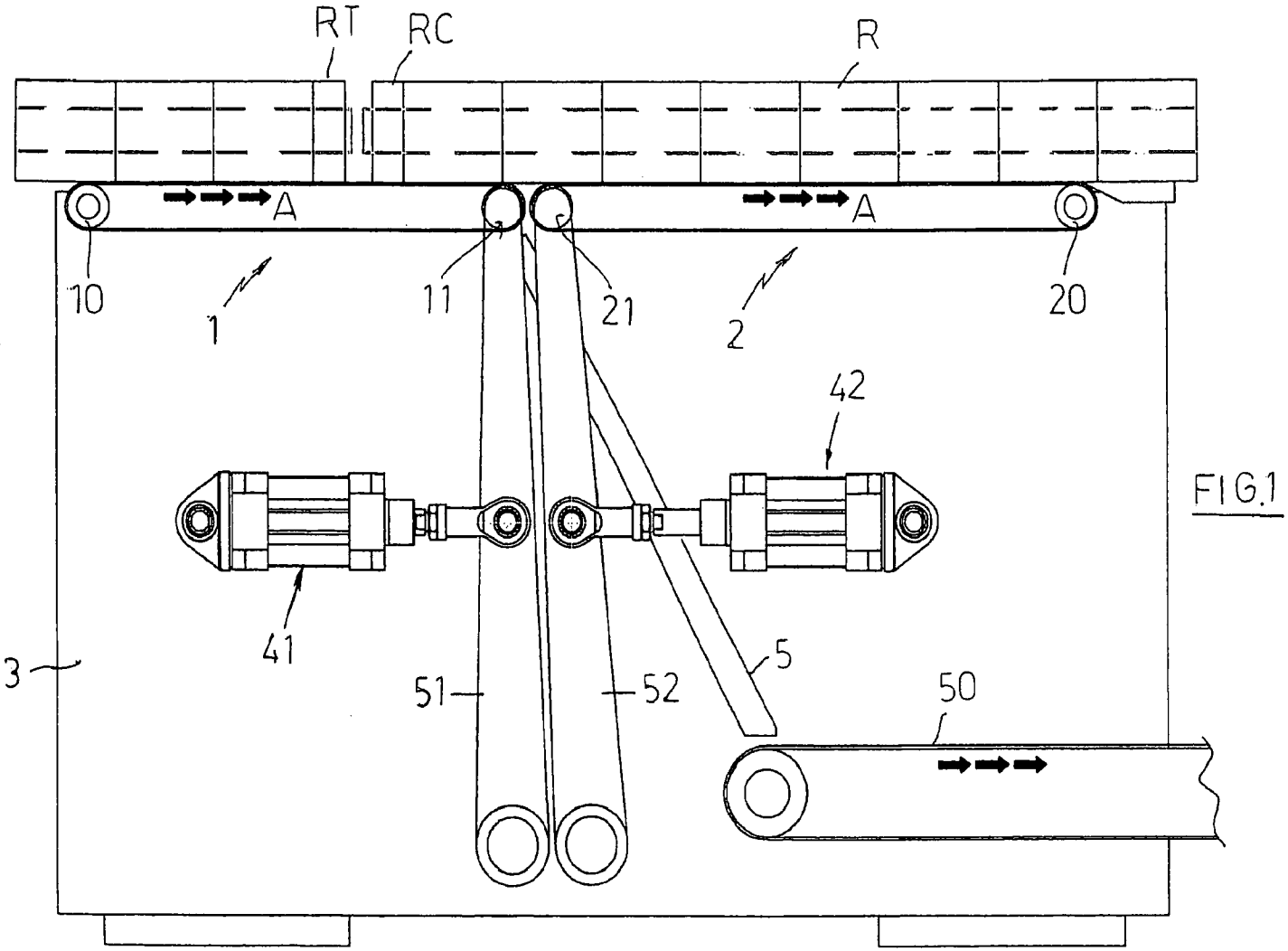
FIG. 1 is a schematic side view of a device according to the present invention in an operating configuration.
Figure 2:
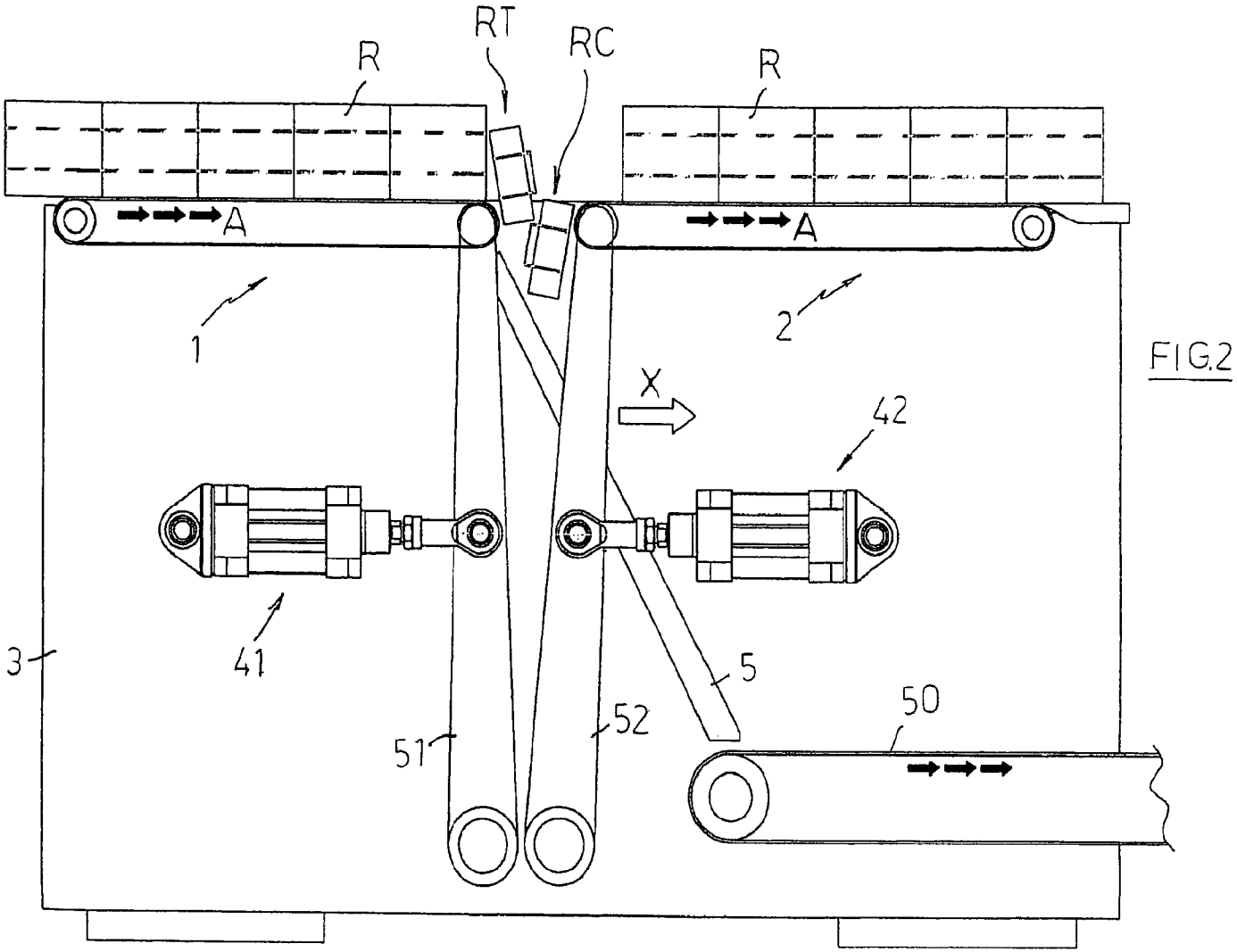
FIG. 2 is a schematic side view of a device according to the present invention in another operating configuration.
Figure 3:
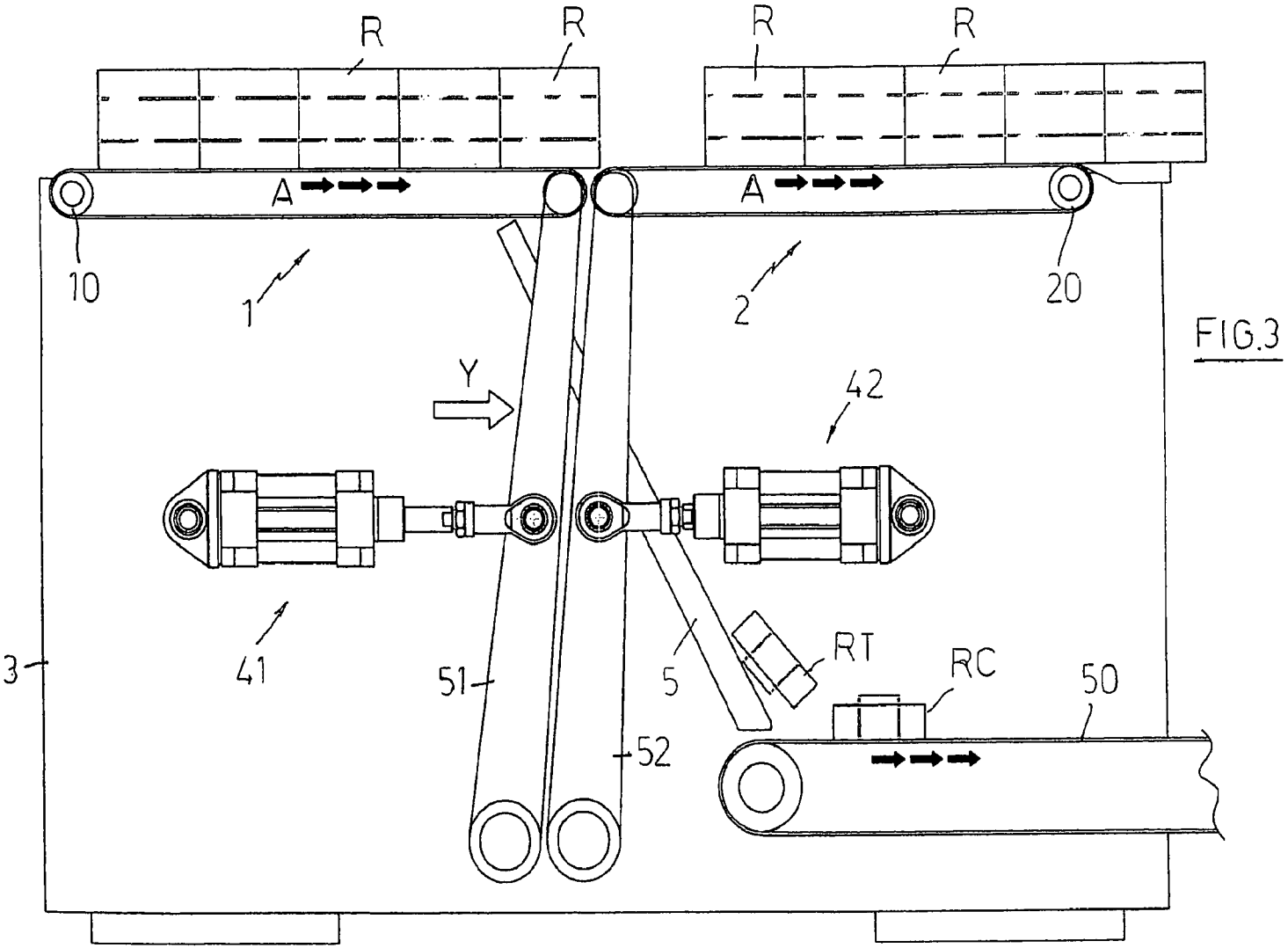
FIG. 3 is a schematic side view of a device according to the present invention in yet another operating configuration.

A device according to the present invention can be positioned between the exit section of a cutting machine (T)—by means of which one or more logs (L) are submitted to a transverse cutting so as to obtain a succession of rolls (R) having predetermined lengths and provided with a head trim (RT) and a tail trim (RC)—and a line for packaging the rolls (R). In the drawings, the broken lines inside the rolls (R) represent their cardboard cores.

The cutting machine (T) and the packaging line can be of the known type. Examples of cutting machines for logs of paper material are provided in EP1582320, US4041813 and EP1040895. Examples of packaging lines for the rolls obtained by cutting the logs are described in US6463713 and WO2007/088567.

With reference to the example shown in FIGS. 1-4, of the enclosed drawings, a device according to the present invention comprises two conveyors (1,2) consisting of more belts ring-closed on respective pulleys (10,11; 20,21), connected to motor means which drive them so that the upper stretch of each of the two conveyors (1,2) always moves forward towards the packaging line (C) (rightwards in the drawings, as indicated by arrows "A"). The conveyors (1,2) are horizontal, that is to say their respective upper and lower stretches are horizontal and at the same height, thus resulting at the same level. Moreover, the conveyors (1,2) are aligned, with the second conveyor (2) downstream of the first conveyor (1) with respect to the direction from which the rolls (R) and trims (RT,RC) produced by the cutting machine (T) come.

The rolls (R) and trims (RT, RC) coming from the cutting machine lie on the upper stretch of the first conveyor (1).

As further described below, the first conveyor (1) moves the rolls (R) and the trims (RT, RC) away from the cutting machine (T), towards the second conveyor (2). The latter receives only the rolls (R) and handles them as indicated by arrows "A" so as to move them away from the first conveyor, that is to say so as to direct them towards the packaging line (C) which is disposed downstream.

Each of the conveyors (1,2) consists of a series of elastic belts (12;22) which are positioned side by side and ring-closed on respective pulleys (10, 11; 20,21). These pulleys are mounted on horizontal shafts (13,14; 23,24) which are oriented perpendicularly to the rings defined by the elastic belts (12,22). In each of the two conveyors (1,2) a shaft (13,23) is fixed that is to say it is supported in a fixed position (free to rotate around its axis) by the flanks of the corresponding support structure (3), whilst the other shaft (14,24) is mounted with its ends passing through corresponding slots (15;25) presented by the flanks of the same structure (3). In this way, the shafts (14,24) can move, bidirectionally, parallel to the direction of the products (R,RT,RC) coming from the cutting machine (as indicated by arrows "A", but in both directions, that is to say both forward and backward, or, in other words, with reference to the drawings, both rightwards and leftwards). Therefore, in the following, the shafts (14) and (24) will be called "mobile shafts" to distinguish them from those (13; 23) supported by the flanks of the structure (3) in a fixed position.

With reference to the example shown in the drawings, the fixed shafts (13) and (23) are more distanced from each other than the mobile shafts (14; 24) which, instead, are positioned in front of each other. The ends of the mobile shafts (14; 24) are connected to actuators (41; 42) which, as further described below, control their bidirectional horizontal movement parallel to the direction indicated by arrows "A", but both forward and backward (with reference to the drawings, both rightwards and leftwards). Each of the actuators (41, 42) is fixed to a flank of the structure (3) and its stem is connected to a corresponding arm (51, 52) which, on its lower side, is hinged to the structure (3). The upper end of each of the arms (51, 52) is hinged to an end of the respective mobile shaft (14, 24). Through the extension or the retraction of the stem of an actuator (41) or (51) the respective mobile shaft (14) or (24) can be moved forward or backward (rightward or leftward in the drawings). When the first mobile shaft (14) is moved forward (rightward in the drawings), the corresponding elastic belts (12) extend. Instead, the belts (22) are extended when the second mobile shaft (24) is moved backwards (leftward in the drawings).

An electric motor (16;26) is mounted on one end of each of the fixed shafts (13,23). The motors control the rotation of the fixed shafts, with a predetermined angular speed, around the respective longitudinal axes. It determines the winding of the corresponding belts (12;22), so that the upper stretches of these belts move as indicated by arrows "A". Each of the motors (16;26) is supported by a flank of the structure (3) by means of a flange (FM).

An example of how the device described above can be used is described below.

In a first step (FIG. 1), in which the rolls (R) and trims (RT, RC) obtained by the subdivision performed by the cutting machine (T) upstream of the device subject of the present invention are aligned and come out of the cutting machine (T), the conveyors (1) and (2) are positioned next to each other so as to form a continuous forward motion plane (A) for the rolls (R) and trims (RT,RC). In this phase, the stem of the actuator (41) is retracted, whilst the stem of the actuator (42) is extracted, so that the mobile shafts (14,24) of the conveyors (1,2) are positioned next to each other.

In a second step (FIG. 2), when the tail trim (RC) of a cut log passes near the first mobile shaft (14), the stem of the actuator (42) is retracted, as indicated by arrow "X", so as to provide an empty space between the first and the second conveyor. Therefore, the trim (RC) falls into the empty space and, guided by a slide (5) disposed for this purpose, it is transferred onto a conveyor belt (50) which is positioned underneath the second conveyor (2) which moves it away from the system. This configuration of the first conveyor (1) and of the second conveyor (2) is maintained until the head trim (RT) of the subsequent cut log passes in correspondence to the first mobile shaft (14) and falls onto the slide (5) and consequently onto the belt (50). The passages are detected by means of an optical sensor (OS), shown only in FIG. 4 and in the block diagram of FIG. 8, which is disposed above the first mobile shaft (14) that is to say in the position the latter assumes when the stem of the corresponding actuator (51) is retracted (position of FIG. 1 and FIG. 4).

In a third step (FIG. 3), the stem of the actuator (41) is retracted so as to cause the extension of the belts (12) of the corresponding conveyor (1) and to eliminate the empty space mentioned above, so the two conveyor belts, form once again a continuous advancing plane on which there are only the rolls (R) and not the trims (RT, RC). The extraction speed of the stem of the actuator (41), that is the forward motion speed of the mobile shaft (14), is preferably equal to or higher than the peripheral speed of the belts (12), that is, it is preferably equal to or higher than the translation speed of the rolls and trims conveyed by the belt (12).

In a fourth step, (FIG. 4) the stem of the actuator (41) is retracted whilst the stem of the actuator (42) is extracted, as indicated by the arrows "W" and "Z" so as to restore the starting position (configuration of FIG. 1) and to allow the repetition of the cycle described above.

Figure 4:
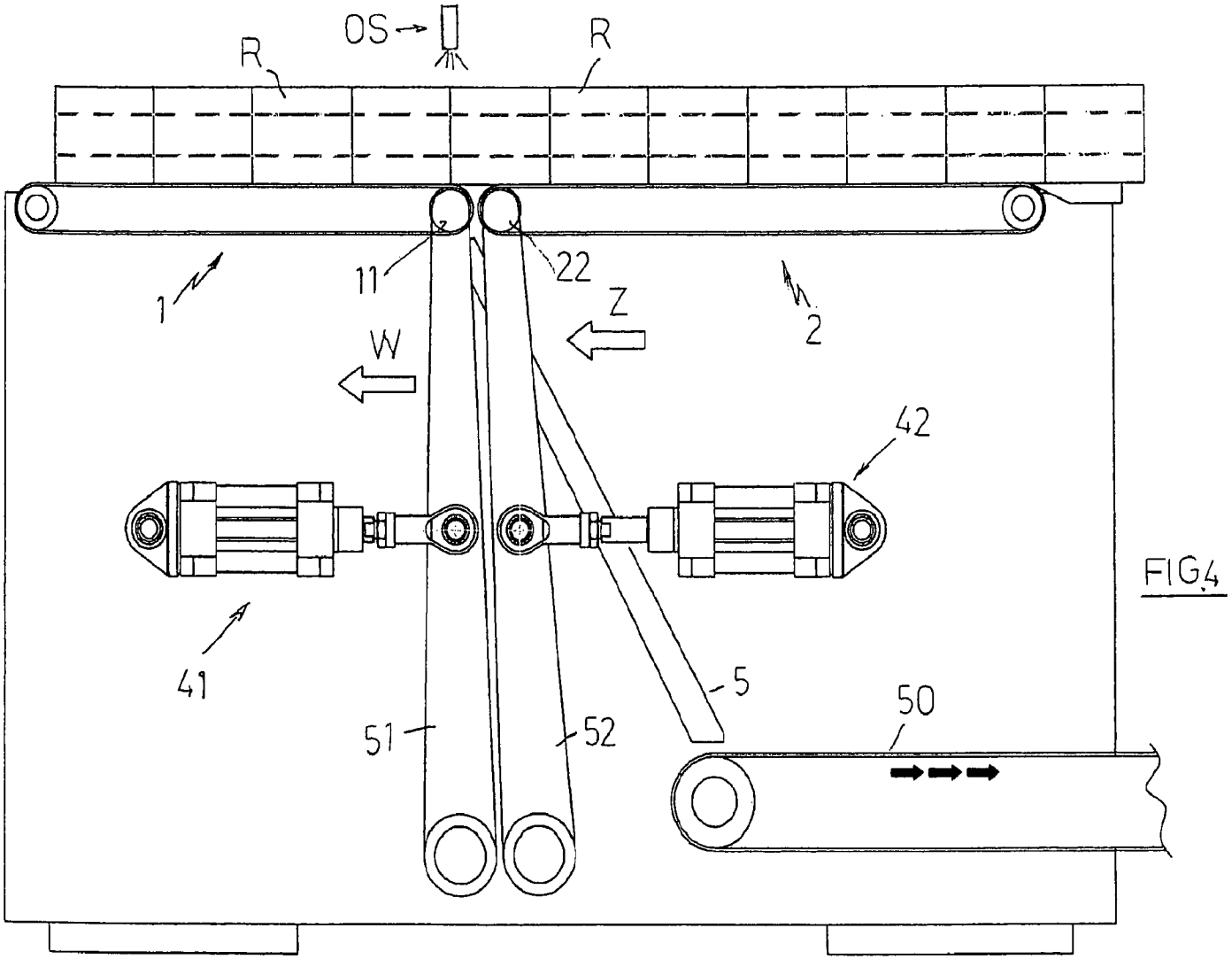
FIG. 4 is a schematic side view of a device according to the present invention in yet another operating configuration.
Figure 5:
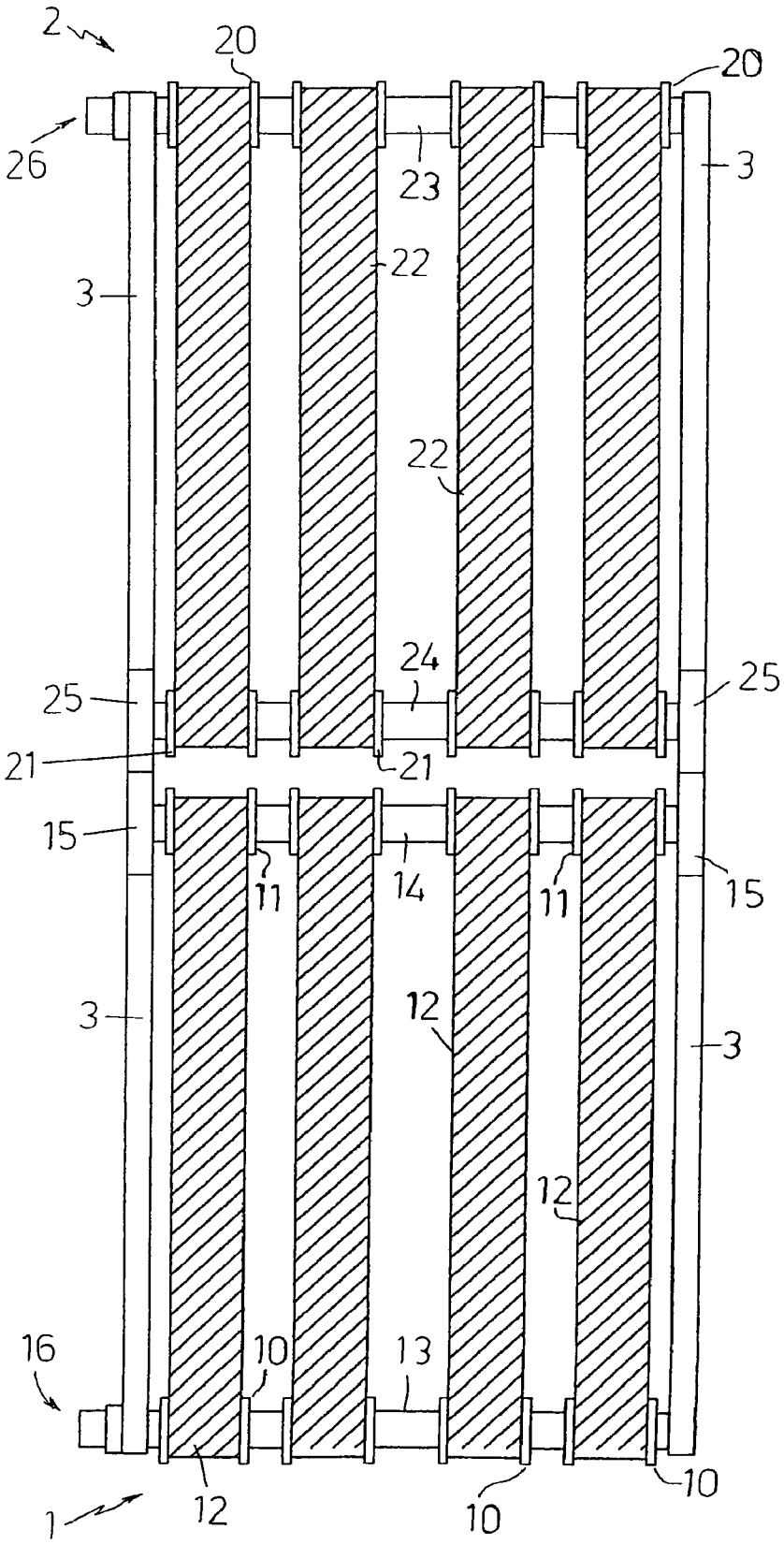
FIG. 5 is a schematic plan view of the device shown in FIGS. 1-4 (in this figure, for simplicity's sake, the arms 51 and 52 are not shown)
Figure 6:
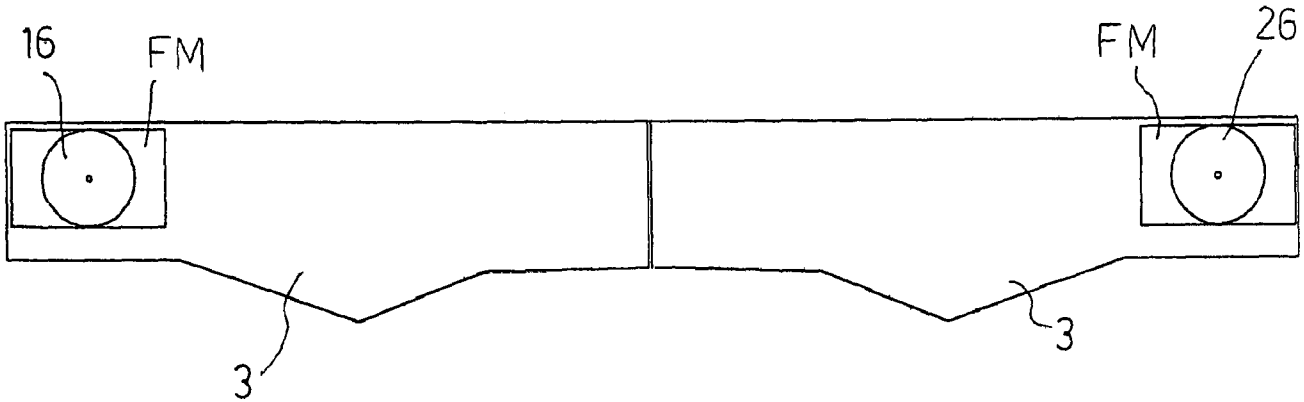
FIG. 6 is a partial lateral view showing the motors which operate the shafts 13 and 23.
Figure 7:
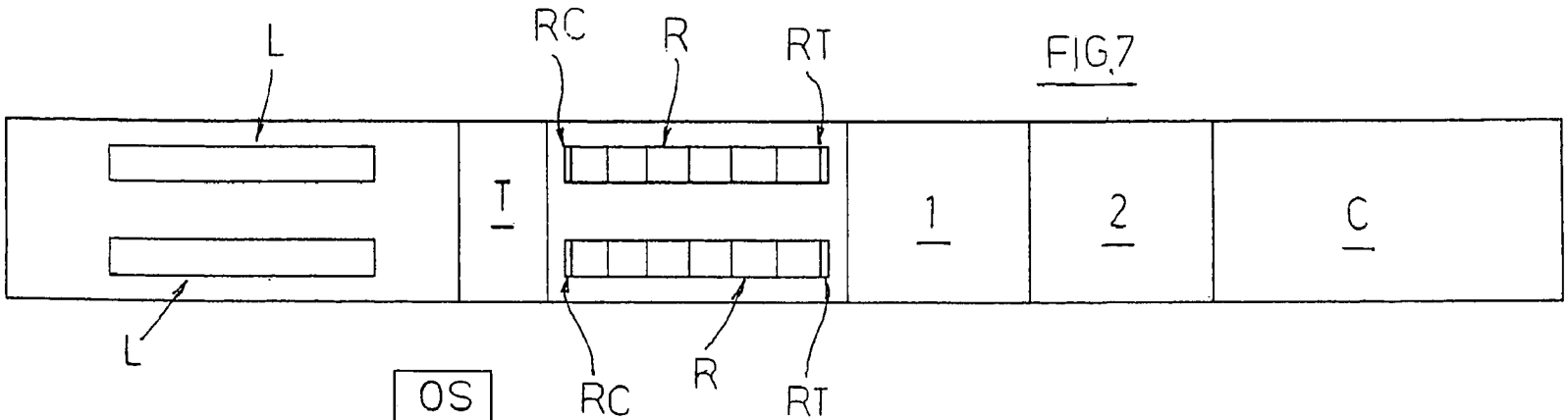
FIG. 7 is a schematic plan view of a manufacturing line in which a device according to the present invention is installed.

During these steps, the belts (12,22) of the conveyors (1,2) continue to move as indicated by arrows "A" so that all the material present on the conveyors (1,2), that is to say the rolls (R) and the trims (RT,RC) which have been obtained by cutting the logs (L), are always moved away from the cutting machine (direction indicated by the arrows "A"). In addition, as illustrated in FIG. 4, once the trims (RT, RC) have been moved away, the rolls (R) are aligned with no intermediate spaces, that is to say they are perfectly positioned next to one another, without any empty spaces between the rolls.

Figure 8:
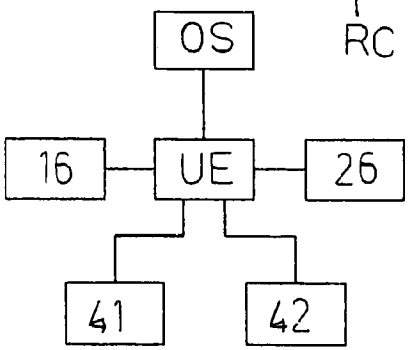
FIG. 8 is a simplified block diagram of the control system for the elements shown in the previous figures.
Figure 9:
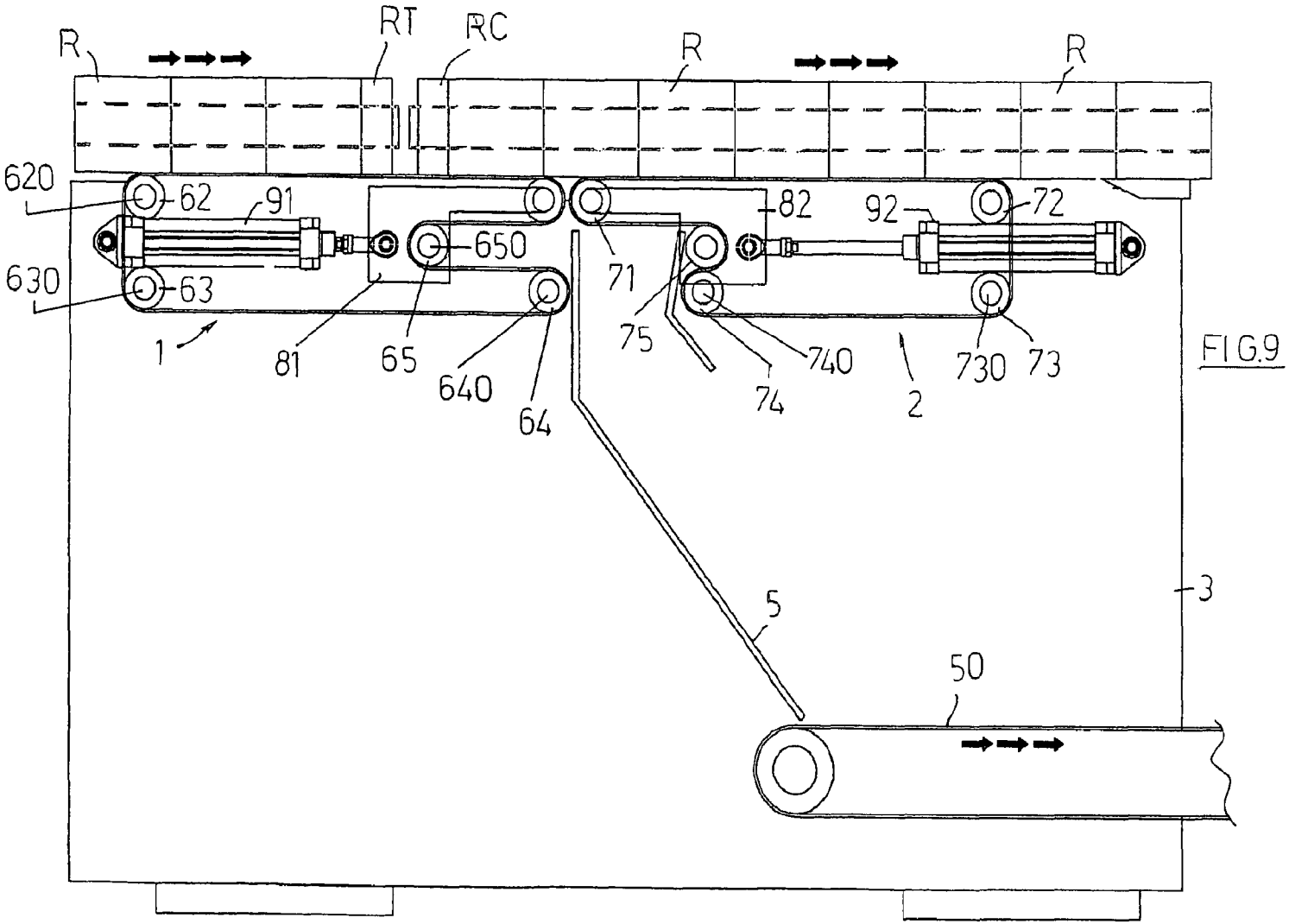
FIG. 9 is a schematic side view of a further embodiment of a device according to the present invention in one operating configuration.
Figure 10:
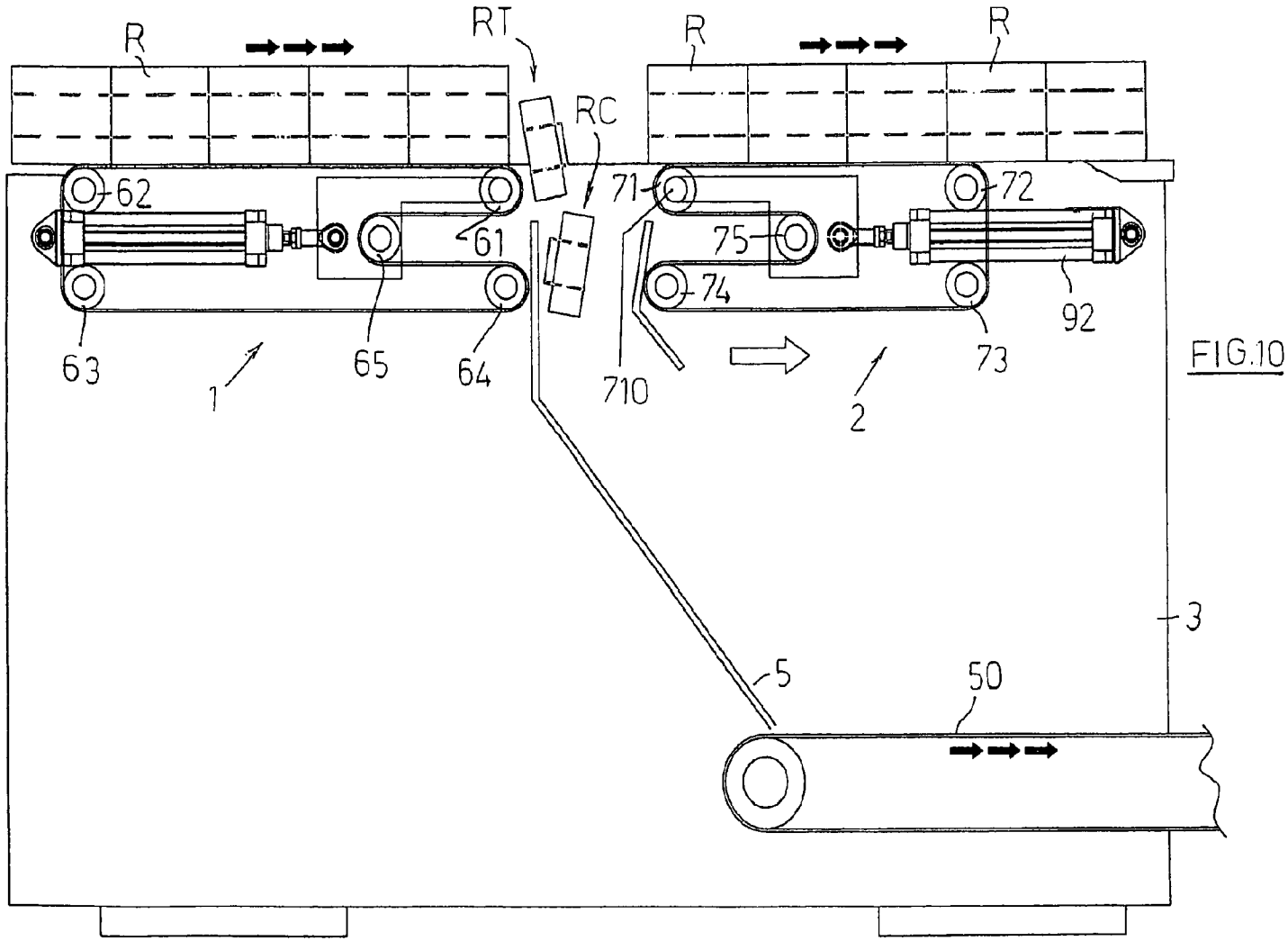
FIG. 10 is a schematic side view of the further embodiment of the device according to the present invention in another operating configuration.
Figure 11:
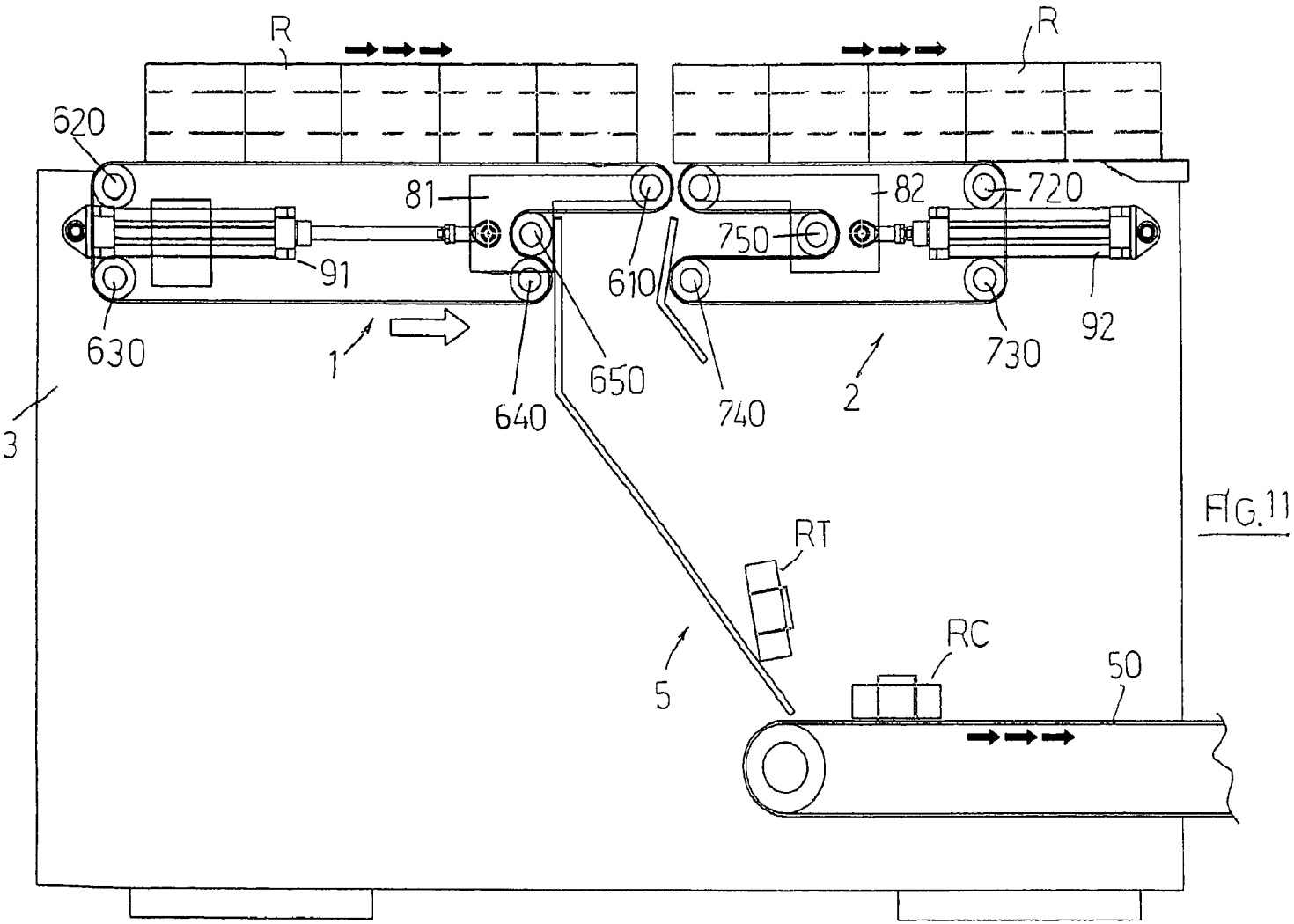
FIG. 11 is a schematic side view of the further embodiment of the device according to the present invention in yet another operating configuration.
Figure 12:
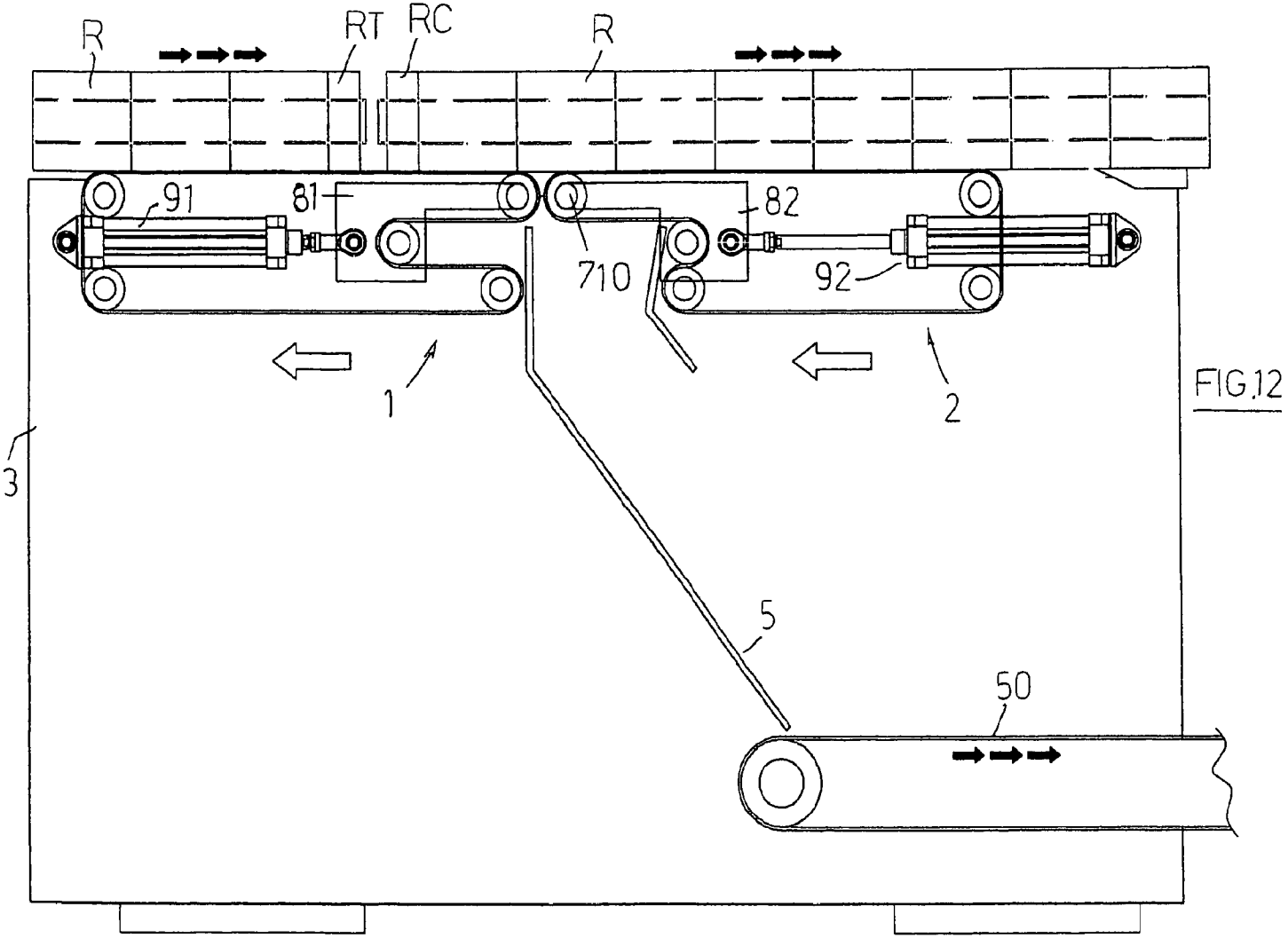
FIG. 12 is a schematic side view of the further embodiment of the device according to the present invention in yet another operating configuration.
Figure 13:
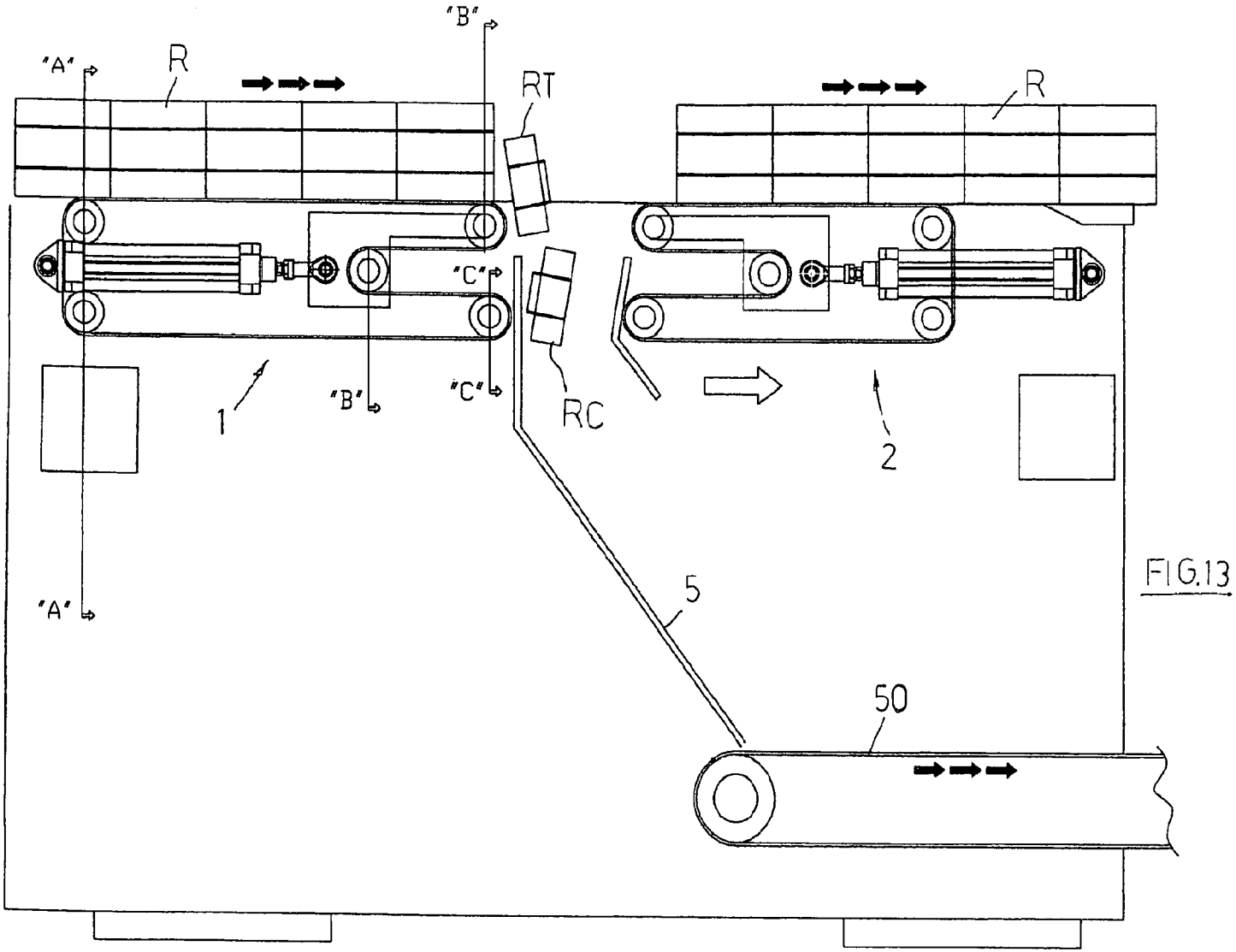
FIG. 13 is analogous to FIG. 10 and it has been reproduced to better represent section lines A-A,B-B and C-C.
Figure 15:
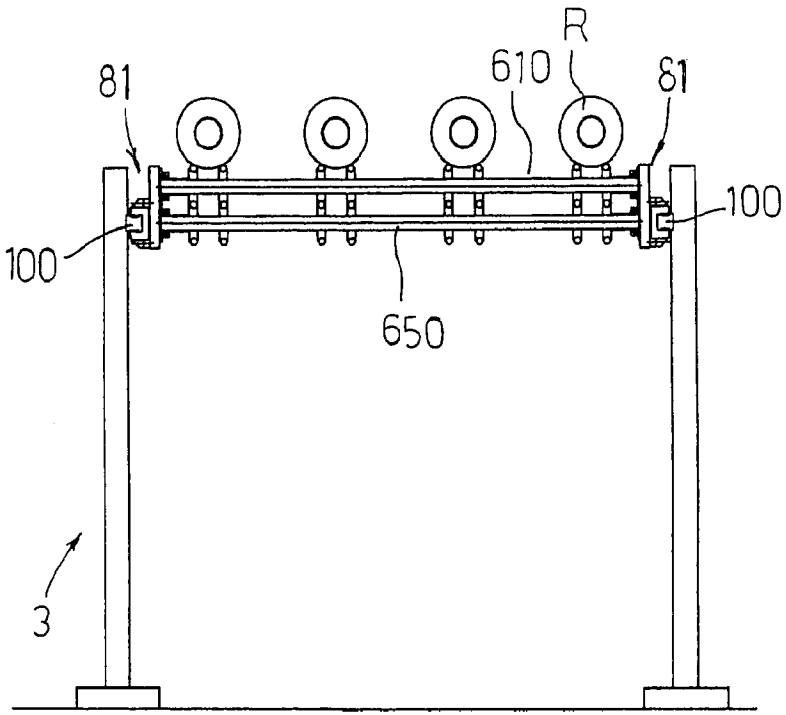
FIG. 15 is a sectional view according to line B-B of FIG. 13.
Figure 14:
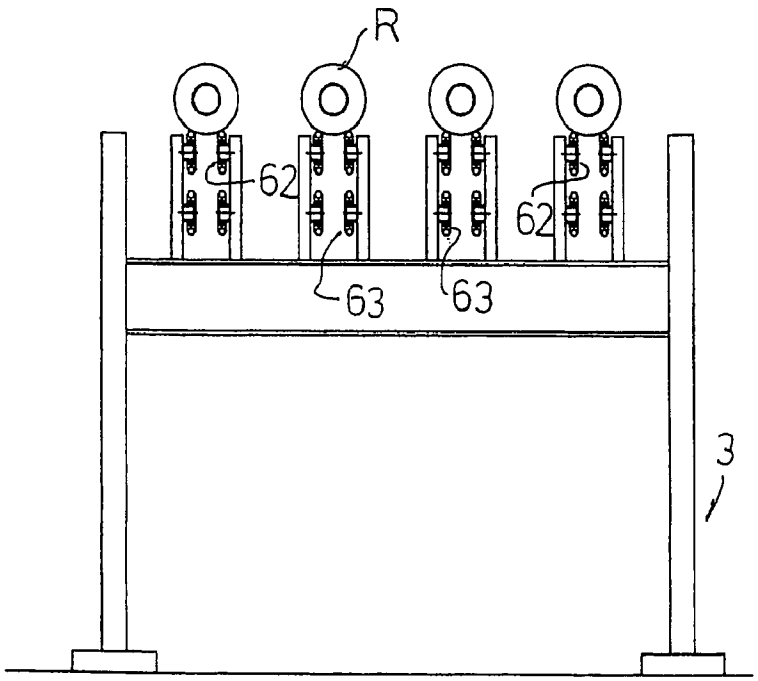
FIG. 14 is a sectional view according to line A-A of FIG. 13.

In the diagram of FIG. 8, the "UE" block represents a programmable electronic unit which is connected to the sensor (OS), to the actuators (41) and (42) and the motors (16) and (26) according to a scheme which is well-known to the industrial automation technicians and, then, not described in more detail.

With reference to the example shown in FIGS. 9-12 of the enclosed drawings, there are, as in the case described above, two extensible conveyors (1,2) disposed downstream of a cutting machine (T) which produces a series of rolls (R) and trims (RT,RC) by cutting one or more paper logs (L). The operating steps and the effects produced by the device shown in FIGS. 9-12 are identical to those described above with reference to FIGS. 1-4. Even in this case, each conveyor (1,2) consists of a plurality of belts ring- closed on respective pulleys (10,11; 20, 21) which are connected to corresponding motor means handling them so that the upper stretch of each of the conveyors (1,2) continuously moves forward towards the packaging line (C) (rightward in the drawings as indicated by arrows "A"). As in the case described above, the conveyors feature their upper and lower horizontal stretches at the same height, that is to say placed horizontally at the same level. In addition, even in this case, the conveyors (1,2) are aligned, with the second conveyor (2) downstream of the first conveyor (1) with respect to the direction from which the rolls (R) and trims (RT,RC) produced by the cutting machine come. Finally, as in the previous example, the rolls (R) and trims (RT,RC) coming from the cutting machine lie on the upper stretch of the first belt (1), whilst the second conveyor handles only the rolls (R), as it does not receive the trims (RT,RC) from the first conveyor (1).

The example shown in FIGS. 9-12 is different from the previous one due to the structure of the conveyors (1,2). In this case, in fact, the belts which define the conveyors (1,2) are not elastic and have a fixed length. Each belt is ring-wound on a plurality of pulleys (61, 62, 63, 64, 65; 71, 72, 73, 74,75) fixed on respective horizontal axis shafts (610, 620, 630, 640, 650; 710, 720, 730, 740, 750) which are oriented perpendicularly to the forward motion direction "A" of the rolls and trims (R,RT,RC).

With reference to the first conveyor (1), there are three shafts in a fixed position (620, 630, 640) and two mobile shafts (610, 650). In the example shown in the drawings there are, starting from the right and going on in the anticlockwise direction, a first mobile shaft (610), a first fixed shaft (620) on the same level as the first mobile shaft (610), a second fixed shaft (630) disposed in a lower position with respect to the first mobile shaft (620), a third fixed shaft (640) on the same level as the second fixed shaft, and a second mobile shaft (650) disposed at an intermediate level and in a backward position with respect to the first mobile shaft (610). The mobile shafts (610, 650) are solid to the front part of a carriage (81) which can be moved horizontally by means of two linear actuators (91) fixed to the support structure (3). The stems of the actuators (91) are connected to the rear part of the carriage (81).

In the same way, with reference to the second conveyor (2), there are three shafts in a fixed position (720, 730, 740) and two mobile shafts (710, 750). In the example shown in the drawings, there, starting from the left and going on in the clockwise direction, a first mobile shaft (710), a first fixed shaft (720) on the same level as the first mobile shaft (710), a second fixed shaft (730) in a lower position with respect to the first fixed shaft (720), a third fixed shaft (740) on the same level as the second fixed shaft (730) and a second mobile shaft (750) disposed at an intermediate level and in a forward position with respect to the first mobile shaft (710). The mobile shafts (710,750) are solid to the front part of a carriage (81) which can be moved horizontally by means of linear actuators (92) fixed to the support structure (3). The stems of the actuators (92) are coupled to the rear part of the carriage (82).

The carriages (81) and (82) slide on horizontal linear guides (100) presented by the internal flanks of the structure (3).

Figure 16:
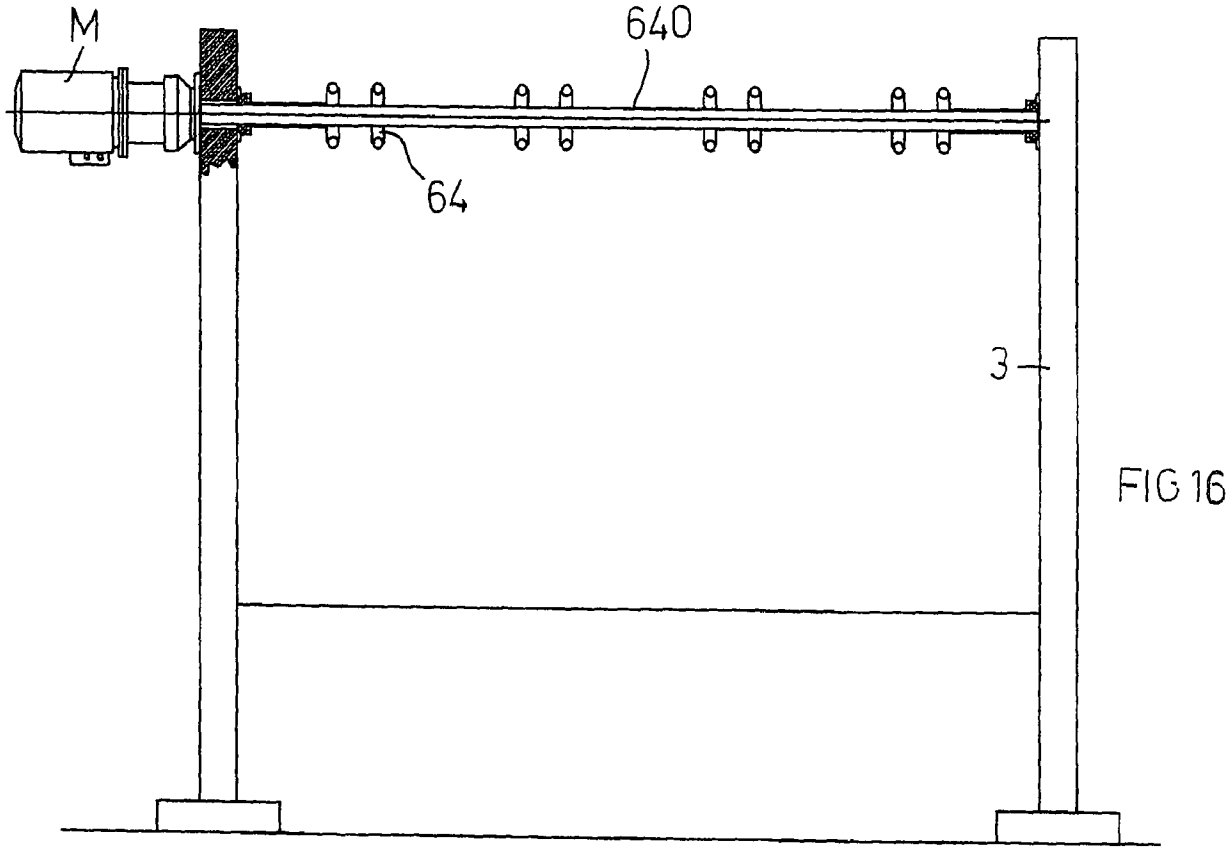
FIG. 16 is a sectional view according to line C-C of FIG. 13.
Figure 17:
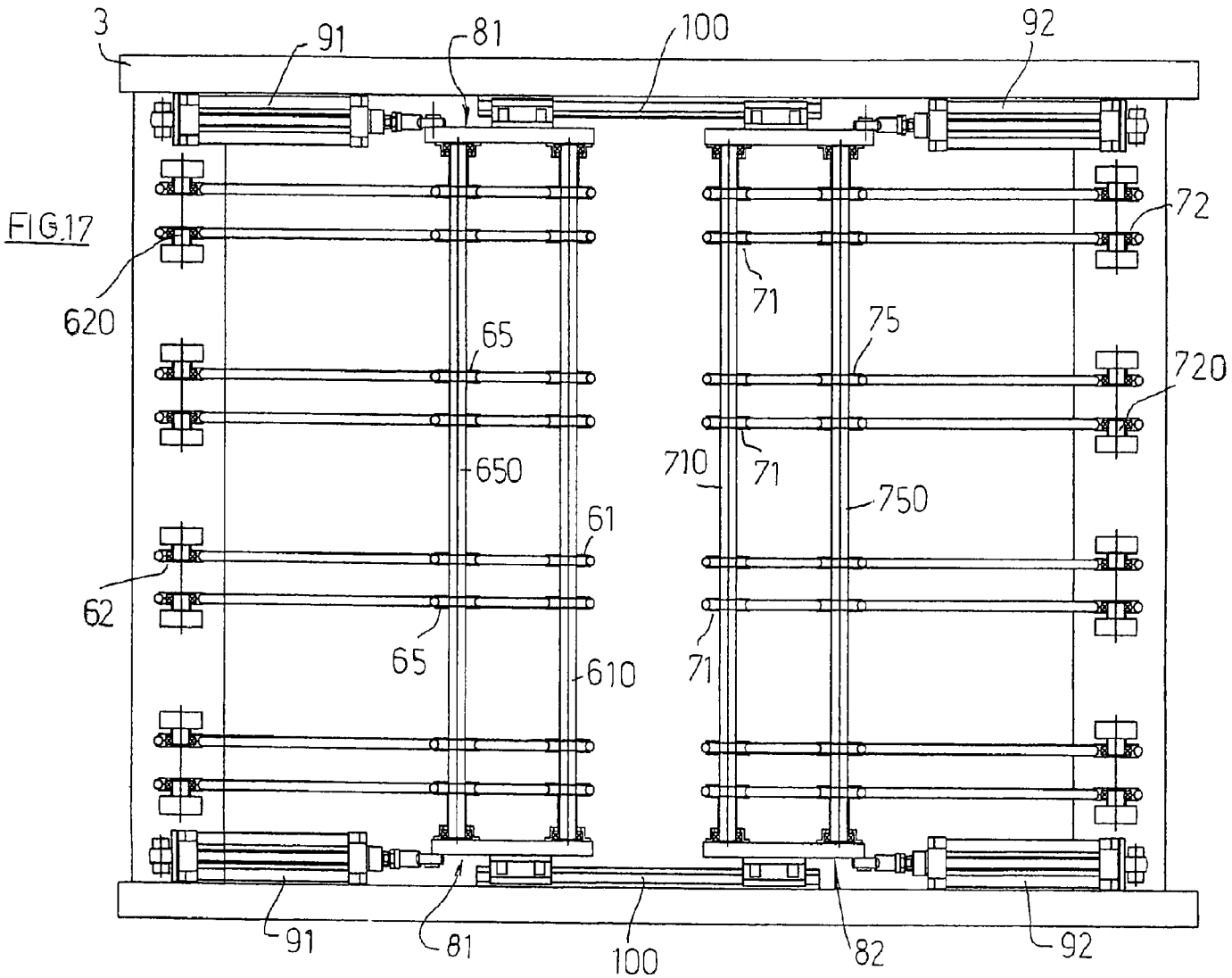
FIG. 17 is a schematic plan view of the device shown in FIG. 13, in which some parts have been omitted to better highlight other parts.

The third fixed shafts (640-740) are motorized. FIG. 16 shows an electric motor (M) which operates the shaft (640).

The extension of the stems of the actuators (91, 92) determines a corresponding variation in the configuration of the belts wound around the pulleys (61-65) and (71-75): the extension of the stem of an actuator (91,92) determines the elongation of the upper section of each belt associated with it, that is to say the elongation of the horizontal section on which the rolls (R) and/or trims (RT,RC) lie, and the shortening of the lower section, that is to say the shortening of the horizontal section opposed to the upper section; instead, the retraction of the stem of an actuator (91,92) determines the shortening of the upper section of each belt associated with it and the elongation of the respective lower section.

As previously said, the operating cycle carried out by the device shown in FIGS. 9-12 is identical to the cycle that has been described with reference to FIGS. 1-4 and, therefore, its description will not be repeated.

In both the examples described above, two opposed extensible conveyors have been described (in the first example, they are conveyors provided with elastic belts; in the second example, they are conveyors provided with non- elastic belts) and the conveyors form a forward motion plane for the rolls (R) and trims (RT,RC) produced by the cutting machine (T), in which the forward motion plane is continuous or discontinuous depending on the configuration assumed by the conveyors (1,2) and in which, starting from a configuration where the first conveyor (1) is not extended whilst the second conveyor is extended and the front part of the first conveyor (1) is next to the rear part of the second conveyor (2), they can be controlled so as to realize the following operation:

retraction of the second conveyor (2) and moving of the rear part of the second conveyor (2) away from the front part of the first conveyor (1) in order to realize a discontinuity on the forward motion plane;

extension of the first conveyor (1), the front part of the first conveyor (1) thus approaching the rear part of the second conveyor (2) in order to restore continuity of the forward motion plane;

inversion of the previous motions with the retraction of the first conveyor (1) and extension of the second conveyor (2) by keeping the front part of the first conveyor (1) close to the rear part of the second conveyor.

It is obvious that when a discontinuity is produced in the forward motion plane, the size of the discontinuity is such that it allows the trims (RT,RC) to fall.

According to the present description the "fixed shafts" are the shafts supported by the structure (3) in a fixed position and the "mobile shafts" are the shafts which can be moved parallel to the direction "A". The shafts are free to rotate around their respective axes.

While specific embodiments of the invention have been shown and described in detail to illustrate the application of the principles of the invention, it will be understood that the invention may be embodied otherwise without departing from such principles.

What is claimed is:

1. A device for discarding trims formed by cutting machines during the cutting of paper logs, the device comprising:

an advancing plane on which paper rolls and trims advance along a given direction, wherein the trims can fall through a discontinuity provided on said advancing plane, said advancing plane being formed by a first extendible conveyor and a second extendible conveyor, each of said conveyors being connected with respective extension and retraction means, said discontinuity on the advancing plane being realized or eliminated depending on the extended or not extended configuration of said conveyors.

2. The device according to claim 1, further comprising a control element, wherein said conveyors, starting from a configuration in which the first conveyor is not extended with the second conveyor being extended and the forward part of the first conveyor is adjacent to the rear part of the second conveyor, are controlled via said control element such that said conveyors are driven as follows:

retraction of the second conveyor and moving of the rear part of the second conveyor away from the front part of the first conveyor in order to form said discontinuity on said forward motion plane;

extension of the first conveyor, the front part of the first conveyor approaching the rear part of the second conveyor in order to restore continuity of said forward motion plane;

inversion of the previous motions with the retraction of the first conveyor and extension of the second conveyor by keeping the front part of the first conveyor close to the rear part of the second conveyor.

3. The device according to claim 1, wherein said conveyors comprise non-elastic belts ring-closed on respective pulleys fixed on respective horizontal shafts which are oriented perpendicularly to said advancing direction of the rolls and trims and which are partly fixed shafts and partly mobile shafts having a bi-directional movement parallel to said advancing direction, one of said extension and retraction means comprising a first arm and a first actuator having a first actuator portion, said first arm engaging said first actuator portion, said first arm engaging one of said partly mobile shafts, another one of said extension and retraction means comprising a second arm and a second actuator having a second actuator portion, said second arm engaging said second actuator portion and another one of said partly mobile shafts, said second actuator being opposite said first actuator.

4. The device according to claim 2, wherein said conveyors comprise non-elastic belts ring-closed on respective pulleys fixed on respective horizontal shafts which are oriented perpendicularly to said advancing direction of the rolls and trims and which are partly fixed shafts and partly mobile shafts having a bi-directional movement parallel to said advancing direction.

5. A device for discarding trims formed by cutting machines during the cutting of paper logs, the device comprising:

a first conveyor;

a second conveyor;

a first extension and retraction means connected to said first conveyor for moving at least a portion of said first conveyor between a first conveyor first position and a first conveyor second position;

a second extension and retraction means connected to said second conveyor for moving at least a portion of said second conveyor between a second conveyor first position and a second conveyor second position, said first conveyor and said second conveyor defining an advancing plane on which paper rolls and trims advance with at least in said first conveyor first position and said second conveyor first position, said first conveyor and said second conveyor defining a gap in said advancing plane with at least said second conveyor in said second conveyor second position.

6. The device according to claim 5, wherein a forward portion of said first conveyor is adjacent to a rear portion of said second conveyor with said first conveyor in said first conveyor first position and said second conveyor in said second conveyor first position, said rear portion of said second conveyor being located at a spaced location from said forward portion of said first conveyor with said first conveyor in said first conveyor first position and said second conveyor in said second conveyor second position, said forward portion of said first conveyor being adjacent to said rear portion of said second conveyor with said first conveyor in said first conveyor second position and said second conveyor in said second conveyor second position.

7. The device according to claim 6, wherein said first conveyor and said second conveyor comprise non-elastic belts ring-closed on respective pulleys fixed on respective horizontal shafts which are oriented perpendicular to an advancing direction of the rolls and trims and which are partly fixed shafts and partly mobile shafts having a bi-directional movement parallel to said advancing direction.

8. The device according to claim 5, wherein said first conveyor and said second conveyor comprise non-elastic belts ring-closed on respective pulleys fixed on respective horizontal shafts which are oriented perpendicular to an advancing direction of the rolls and trims and which are partly fixed shafts and partly mobile shafts having a bi-directional movement parallel to said advancing direction.

9. The device according to claim 5, wherein said first extension and retraction means comprises a first actuator having a first actuator portion and a first connecting portion, said first conveyor comprising a first horizontal shaft and a second horizontal shaft, said first horizontal shaft being located at a spaced location from said second horizontal shaft, said first horizontal shaft being mounted for movement such that said first horizontal shaft moves relatives to said second horizontal shaft upon actuation of said first actuator, said first connecting portion being in direct contact with said first horizontal shaft, said first actuator portion being in direct contact with said first connecting portion.

10. The device according to claim 9, wherein said second extension and retraction means comprises a second actuator having a second actuator portion and a second connecting portion, said second conveyor having one horizontal shaft and another horizontal shaft, said one horizontal shaft being located at a spaced location from said another horizontal shaft, said one horizontal shaft being mounted for movement such that said one horizontal shaft moves relative to said another horizontal shaft upon actuation of said second actuator, said second connecting portion being in direct contact with said one horizontal shaft, said second actuator portion being in direct contact with said second connecting portion.

11. The device according to claim 10, wherein said first connecting portion is opposite said second connecting portion and said first actuator is opposite said second actuator.

12. The device according to claim 5, further comprising a control element, wherein said first and said second conveyor, starting from a configuration in which the first conveyor is not extended with the second conveyor being extended and a forward part of the first conveyor is adjacent to a rear part of the second conveyor, are controlled via said control element such that said conveyors are driven via said first extension and retraction means and said second extension and retraction means as follows:

retraction of the second conveyor and moving of the rear part of the second conveyor away from the front part of the first conveyor in order to form said gap;

extension of the first conveyor, the front part of the first conveyor approaching the rear part of the second conveyor in order to close said gap;

inversion of the previous motions with the retraction of the first conveyor and extension of the second conveyor by keeping the front part of the first conveyor close to the rear part of the second conveyor.

13. A device for discarding trims formed by cutting machines during the cutting of paper logs, the device comprising:

a first conveyor;

a second conveyor;

a first conveyor moving means connected to said first conveyor for moving at least a portion of said first conveyor in a direction of an advancing direction of rolls and trims and a direction opposite the advancing direction of the rolls and trims such that said at least said portion of said first conveyor moves between a first conveyor first position and a first conveyor second position;

a second conveyor moving means connected to said second conveyor for moving at least a portion of said second conveyor in the direction of the advancing direction of the rolls and trims and the direction opposite the advancing direction of the rolls and trims such that said at least said portion of said second conveyor moves between a second conveyor first position and a second conveyor second position, said first conveyor and said second conveyor defining an advancing plane for advancing the rolls and trims, said first conveyor and said second conveyor defining a gap in said advancing plane with at least said portion of said second conveyor in said second conveyor second position.

14. The device according to claim 13, wherein a forward portion of said first conveyor is adjacent to a rear portion of said second conveyor with said at least said portion of said first conveyor in said first conveyor first position and said at least said portion of said second conveyor in said second conveyor first position, said rear portion of said second conveyor being located at a spaced location from said forward portion of said first conveyor with said at least said portion of said first conveyor in said first conveyor first position and said at least said portion of said second conveyor in said second conveyor second position, said forward portion of said first conveyor being adjacent to said rear portion of said second conveyor with said at least said portion of said first conveyor in said first conveyor second position and said at least said portion of said second conveyor in said second conveyor second position.

15. The device according to claim 14, wherein said first conveyor and said second conveyor comprise non-elastic belts ring-closed on respective pulleys fixed on respective horizontal shafts which are oriented perpendicular to an advancing direction of the rolls and trims and which are partly fixed shafts and partly mobile shafts having a bi-directional movement parallel to said advancing direction.

16. The device according to claim 13, wherein said first conveyor and said second conveyor comprise non-elastic belts ring-closed on respective pulleys fixed on respective horizontal shafts which are oriented perpendicular to an advancing direction of the rolls and trims and which are partly fixed shafts and partly mobile shafts having a bi-directional movement parallel to said advancing direction.

17. The device according to claim 13, wherein said first conveyor moving means comprises a first actuator having a first actuator portion and a first connecting portion, said first conveyor comprising a first horizontal shaft and a second horizontal shaft, said first horizontal shaft being located at a spaced location from said second horizontal shaft, said first horizontal shaft being mounted for movement such that said first horizontal shaft moves relative to said second horizontal shaft upon actuation of said first actuator, said first connecting portion being in direct contact with said first horizontal shaft, said first actuator portion being in direct contact with said first connecting portion.

18. The device according to claim 17, wherein said second conveyor moving means comprises a second actuator having a second actuator portion and a second connecting portion, said second conveyor having one horizontal shaft and another horizontal shaft, said one horizontal shaft being located at a spaced location from said another horizontal shaft, said one horizontal shaft being mounted for movement such that said one horizontal shaft moves relative to said another horizontal shaft upon actuation of said second actuator, said second connecting portion being in direct contact with said one horizontal shaft, said second actuator portion being in direct contact with said second connecting portion.

19. The device according to claim 18, wherein said first connecting portion is opposite said second connecting portion and said first actuator is opposite said second actuator.

20. The device according to claim 13, further comprising a control element, wherein said first and said second conveyor, starting from a configuration in which the first conveyor is not extended with the second conveyor being extended and a forward part of the first conveyor is adjacent to a rear part of the second conveyor, are controlled via said control element such that said conveyors are driven via said first conveyor moving means and said second conveyor moving means as follows:

retraction of the second conveyor and moving of the rear part of the second conveyor away from the front part of the first conveyor in order to form said gap;

extension of the first conveyor, the front part of the first conveyor approaching the rear part of the second conveyor in order to close said gap;

inversion of the previous motions with the retraction of the first conveyor and extension of the second conveyor by keeping the front part of the first conveyor close to the rear part of the second conveyor.

* * * * *